United States Patent [19]

Nagase et al.

[11] Patent Number: 4,828,507

[45] Date of Patent: May 9, 1989

[54] VENTILATION WATERPROOF CONNECTOR

[75] Inventors: Kazuo Nagase; Toshio Tagaki, both of Kanagawa; Takayoshi Endo, Shizuoka; Satoru Murofushi, Shizuoka; Masayuki Yamamoto, Shizuoka, all of Japan

[73] Assignees: Yazaki Corporation; Nissan Motor Co., Ltd., both of Japan

[21] Appl. No.: 210,416

[22] Filed: Jun. 21, 1988

[30] Foreign Application Priority Data

Jun. 22, 1987 [JP] Japan ..... 62-94641

[51] Int. Cl.[4] ..... H01R 4/60; H01R 13/52

[52] U.S. Cl. ..... 439/206; 439/278

[58] Field of Search ..... 439/190, 191, 192, 198, 439/205, 206, 271, 272, 278, 913

[56] References Cited

U.S. PATENT DOCUMENTS 4,735,581 4/1988 Endo et al. ..... 439/278

FOREIGN PATENT DOCUMENTS 1569968 12/1975 United Kingdom .

*Primary Examiner*—Eugene F. Desmond
*Assistant Examiner*—Stephen A. Zagrobelny
*Attorney, Agent, or Firm*—Wigman & Cohen

[57] ABSTRACT

To easily change an ordinary waterproof connector to a ventilation waterproof connector provided with a ventilation tube for introducing an atmospheric pressure into the connector housing to reduce pressure difference between inside and outside of the connector, a single ventilation tube is mechanically fixed to a connector terminal in the same way as when plural connector wires are electrically fixed to the same connector terminals, without changing the housing structure or preparing additional parts.

5 Claims, 2 Drawing Sheets

VENTILATION WATERPROOF CONNECTOR

BACKGROUND OF THE INVENTION

1. Field of the Invention

The present invention relates to a ventilation waterproof connector and more specifically to a waterproof connector provided with a ventilation tube for introducing an outside air into the connector housing to prevent water permeation into the housing due to pressure difference between inside and outside of the housing.

2. Description of the Prior Art

When an ordinary waterproof connector having no ventilation tube is used under severe ambient conditions where temperature and/or pressure changes violently and therefore the connector packing is damaged, water readily enters into the connector housing from the outside due to pressure difference between the inside and the outside of the connector housing. To solve this problem, a ventilation tube is connected to the connector housing to match the connector inside pressure with the connector outside pressure. The reason why the ventilation tube is connected to the housing without simply forming a vent hole in the connector housing is to lead the free end of the ventilation tube to a safe place from which water will not be introduced into the connector housing.

A ventilation waterproof connector incorporated in an oil pressure switch for automotive vehicles will be described hereinbelow by way of example. This switch is turned on or off by a diaphragm housed in a pressure switch housing and moved by pressure introduced to one side of the diaphragm. Therefore, it is necessary to keep the other side of the diaphragm at a constant atmospheric pressure. In this case, when a vent hole is simply formed in the switch housing, there exists a problem in that water may enter into the switch housing and therefore the diaphragm may be corroded. Therefore, a ventilation tube is connected to the switch housing usually in parallel to the switch cable led to the pressure switch, in order to avert a complicated wire and tube arrangement.

As described above, in a waterproof connector used under severe ambient conditions or connected to a special device (e.g. pressure switches), an additional ventilation tube is connected in parallel to the connector cable in order to keep the inside pressure at a constant atmospheric pressure.

FIG. 1 is an example of prior-art ventilation waterproof connectors, disclosed in Japanese Published Examined (Kokoku) Utility Model Appl. No. 56-31030, entitled Breathing Tube for Waterproof Connector. In the drawing, a male connector housing 1 having two male connector terminals 3 is mated with a female connector housing 2 having two female connector terminals 4. Two wires 5 are inserted into two holes formed in the male connector housing 1, and retained to the housing 1 by wire stoppers 8. Each wire conductor 5*a* of the wire 5 is fixed to a conductor connecting portion 3*a* of the male connector terminal 3. In the same way, each wire conductor 9*a* of the wire 9 is fixed to a conductor connecting portion 4*a* of the female connector terminal 4. In addition, a ventilation tube 6 arranged substantially in parallel to the wires 5 and bundled by a tape is also inserted into a hole formed in the male connector housing 1 and retained to the housing 1 with a tube stopper 7.

In the prior-art ventilation waterproof connector shown in FIG. 1, since an additional ventilation stopper 7 to be designed for each connector housing 1 must be mounted to prevent the ventilation tube 6 from being removed from the male connector housing 1, there exists a problem in that the number of parts increases and different jigs must be prepared, thus resulting in a higher cost. Further, in the above-mentioned prior-art document (No. 56-31030), although a ventilation waterproof connector having no tube stopper is disclosed, since the free end of the ventilation tube is not retained firmly, there exists another problem in that the ventilation tube is not stably connected to the connector housing.

The above-mentioned drawbacks involved in the prior-art ventilation waterproof connector are not desirable, in particular when the connectors are assembled by an automatic assembly process or system.

SUMMARY OF THE INVENTION

With these problems in mind, therefore, it is the primary object of the present invention to provide a reliable ventilation waterproof connector which can easily be modified from an ordinary non-ventilation waterproof connector, without preparing an additional parts and jigs.

To achieve the above-mentioned object, a ventilation waterproof connector according to the present invention comprises: (a) a connector housing; (b) at least two connector terminals housed within said connector housing; (c) at least one connector wire watertightly led into said connector housing and electrically fixed to said connector terminals; and (d) a single ventilation tube also watertightly led into said connector housing and mechanically fixed to said connector terminals in the same manner as in said connector wire.

In the ventilation waterproof connector according to the present invention, since a single ventilation tube can be mechanically fixed to a connector terminal in the same way as when plural connector wires are electrically fixed to the same connector terminals, without changing the housing structure or preparing additional parts and jigs, it is possible to easily change an ordinary waterproof connector to a ventilation waterproof connector provided with the ventilation tube. Further, the ventilation waterproof connector of the present invention can be assembled automatically by the same assembly system as for the ordinary waterproof connector.

BRIEF DESCRIPTION OF THE DRAWINGS

The features and advantages of the ventilation waterproof connector according to the present invention will be more clearly appreciated from the following description taken in conjunction with the accompanying drawings in which.

DETAILED DESCRIPTION OF THE PREFERRED EMBODIMENTS

Figure 1:
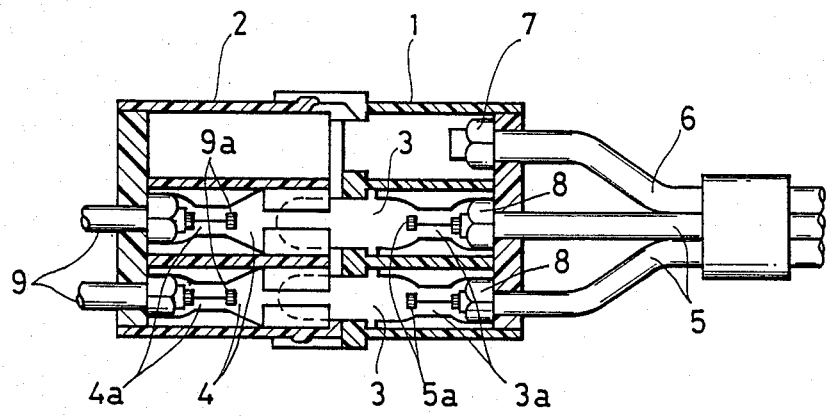
FIG.1 (Prior Art)
FIG. 1 is a cross-sectional view showing a prior-art ventilation waterproof connector, by way of example.
Figure 2A:
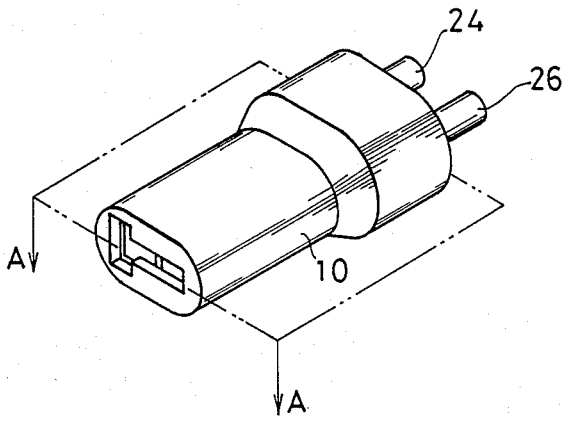
FIG. 2A is a perspective view showing a ventilation waterproof female connector according to the present invention.
Figure 2B:
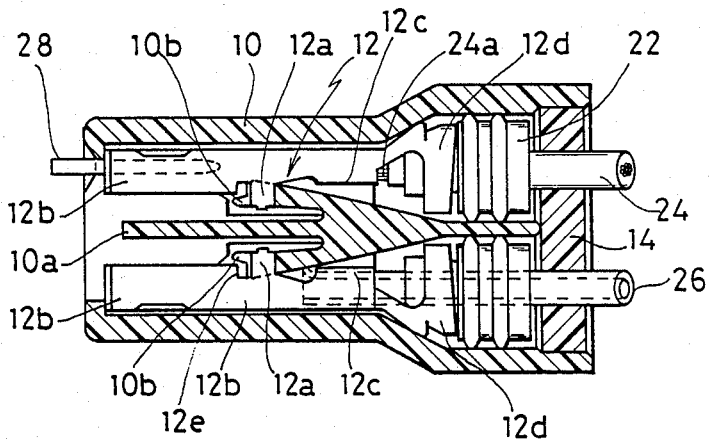
FIG. 2B is a cross-sectional view taken along a plane A shown in FIG. 2A.

An embodiment of the ventilation waterproof connector according to the present invention will be described in detail with reference to FIGS. 2A and 2B. FIG. 2A is a perspective view thereof and FIG. 2B is a cross-sectional view taken along the plane A shown in FIG. 1A.

In the drawings, a ventilation waterproof female connector is composed of a synthetic resin female connector housing 10, a rear holder 14, a connector wire 24, a ventilation tube 26, a pair of female connector terminals 12, and a pair of sealing rubbers 22. The connector housing 10 is divided into two spaces by a partition 10*a* according to the shape of the female connector terminal 12. Further, the connector housing 10 is formed with a pair of lance-shaped engage portions 10*b* branched and extending from the partition 10*a* to hold the female connector terminals 12 in position within the connector housing 10.

The female connector terminal 12 is formed with a female terminal end 12*b* engaged with a terminal end 28 of a male connector; a terminal stabilizer 12*a* fitted to the inner wall of the connector housing 10 to prevent the terminal 72 from being twisted or inserted reversely; a wire barrel 12*c* for crimping one end of the conductor 24*a* of the wire 24; an insulation barrel 12*d* for crimping the sealing rubber 22; and a terminal holding portion 12*e* engaged with the lance-shaped engage portions 10*b* of the housing 10.

Therefore, the wire 24 is connected to the female terminal 12 by crimping the wire barrel 12*c* to the conductor end 24*a* of the wire 24. Further, the sealing rubber 22 fitted to the wire 24 is fixed to the female terminal 12 by crimping the insulation barrel 12*d* to the sealing rubber 22.

In the same way, the ventilation tube 26 is connected to the female terminal 12 by crimping the wire barrel 12*c* to the free end of the ventilation tube 26. Further, the sealing rubber 22 fitted to the ventilation tube 26 is fixed to the female terminal 12 by crimping the insulation barrel 12*d* to the sealing rubber 22. In general, since the tube 26 is made of a hard material such as nylon, the tube is not crashed when fixed to the female terminal 12. In fixing the tube 26, the wire barrel 12c is crimping by reducing the diameter of the tube 26 a little. Once fixed to the female terminal 12, the ventilation tube 26 will not be removed easily in cooperation with the frictional force generated between the ventilation tube 26 and the sealing rubber 22 or the rear holder 14. Further, when the ventilation tube 26 is not hard, a hard wire is inserted into the tube 26 before crimping, in order to prevent the tube diameter from being reduced and the ventilation efficiency from being lowered.

In assembly, the wire 24 is passed through the rear holder 14, and the sealing rubber 22; the wire conductor end 24*a* is fixed to the wire barrel 12*c* of the female terminal 12 by crimping; and the sealing rubber 22 is fixed to the insulation barrel 12*d* by crimping. In the same way, the ventilation tube 26 is passed through the rear holder 14, and the sealing rubber 22; the ventilation tube 26 is fixed to the wire barrel 12*c* of the female terminal 12 by crimping; and the sealing rubber 22 is fixed to the insulation barrel 12*d* by crimping.

After the wire 24 and the tube 26 have been fixed to the female terminals 12, these two female terminals 12 are supported within the connector housing 10 by fitting the stabilizer 12*a* to the inner wall of the housing 10 to prevent the terminal from being twisted or inserted reversely; and then the rear holder 14 is pressure fitted to the housing end. As described above, the ventilation tube 26 can be fixed to the connector in quite the same way as in the wire 24. That is, it is unnecessary to prepare a special jig for fixing the ventilation tube 26 to the connector housing 10. Therefore, the above connector is desirable in particular when assemble by an automatic assembly system.

Thereafter, the female connector 10 is mated with another male connector (not shown) by engaging the female terminal 12 with an male terminal end (pin) 28 of the male connector.

Although not described, it is possible to form and assemble the male connector in quite the same way as in the female connector. In this case, the female connector terminal 12 is replaced with the male connector terminal. Further, in the male connector, the male terminal end pin connected to the female connector terminal to which the tube 26 is fixed is preferably omitted to reduce the ventilation resistance of air passed through the tube 26 or to improve the response characteristics of pressure fluctuation on the external free end side of the ventilation tube 26.

In the embodiment described above, the female connector having only a single wire 24 and a single ventilation tube 26 has been explained by way of example. Without being limited thereto, however, the present invention can be applied to other connectors having a plurality of wires, by replacing one of the wires with a single ventilation tube.

As described above, in the ventilation waterproof connector of the present invention, since the ventilation tube can be fixed to the connector terminal simply by crimping the terminal, it is unnecessary to modify the ordinary connector structure or to prepare an additional parts and jig. That is, it is possible to easily change the ordinary waterproof connector to the ventilation waterproof connector. Further, since the structure of the ventilation waterproof connector of the present invention is substantially the same as that of the ordinary waterproof connector, this is very convenient when the ventilation waterproof connector is assembled through automatic assembling steps.

What is claimed is:

1. A ventilation waterproof connector, comprising:

(a) a connector housing;

(b) at least two connector terminals housed within said connector housing;

(c) at least one connector wire watertightly led into said connector housing and electrically fixed to said connector terminals; and (d) a single ventilation tube also watertightly led into said connector housing and mechanically fixed to said connector terminals in the same manner as in said connector wire.

2. The ventilation waterproof connector of claim 1, which further comprises at least two waterproof sealing rubbers being fitted to said connector wire and said ventilation tube, respectively and located between an inner wall of said connector housing and one end of said connector terminal.

3. The ventilation waterproof connector of claim 2, wherein said connector terminal comprises:

(a) a terminal end engageable with a terminal end of another mating connector terminal;

(b) a terminal holding portion engageable with said connector housing therewithin;

(c) a wire barrel for crimping an end of said connector wire or said ventilation tube; and (d) an insulation barrel for crimping said wire/tube sealing rubber.

4. A ventilation waterproof connector having a housing; plural connector terminals; at least one connector wire watertightly led into the housing and connected to the connector terminal; and a single ventilation tube also watertightly led into the housing to introduce outer pressure into the housing to reduce pressure difference between outside and inside of said connector housing, wherein said single ventilation tube is crimped to one of said connector terminals in the same way as in said connector wire.

5. The ventilation waterproof connector of claim 4, wherein said connector wire and said ventilation tube are each passed through a sealing rubber, respectively located between said connector terminal and an inner surface of said housing.

* * * * *